US011842722B2

(12) United States Patent
Yu et al.

(10) Patent No.: US 11,842,722 B2
(45) Date of Patent: Dec. 12, 2023

(54) SPEECH SYNTHESIS METHOD AND SYSTEM

(71) Applicant: AI SPEECH CO., LTD., Jiangsu (CN)

(72) Inventors: Kai Yu, Suzhou (CN); Zhijun Liu, Suzhou (CN); Kuan Chen, Suzhou (CN)

(73) Assignee: AI SPEECH CO., LTD., Jiangsu (CN)

( * ) Notice: Subject to any disclaimer, the term of this patent is extended or adjusted under 35 U.S.C. 154(b) by 0 days.

(21) Appl. No.: 17/908,014

(22) PCT Filed: Jun. 9, 2021

(86) PCT No.: PCT/CN2021/099135

§ 371 (c)(1),
(2) Date: Aug. 30, 2022

(87) PCT Pub. No.: WO2022/017040

PCT Pub. Date: Jan. 27, 2022

(65) Prior Publication Data

US 2023/0215420 A1 Jul. 6, 2023

(30) Foreign Application Priority Data

Jul. 21, 2020 (CN) ..... 202010706916.4

(51) Int. Cl.
*G10L 25/30* (2013.01)
*G10L 13/047* (2013.01)

(52) U.S. Cl.
CPC ..... *G10L 13/047* (2013.01); *G10L 25/30* (2013.01)

(58) Field of Classification Search
CPC ..... G10L 13/047; G10L 25/30
(Continued)

(56) References Cited

U.S. PATENT DOCUMENTS 10,249,314 B1 * 4/2019 Aryal ..... G10L 21/007
11,017,761 B2 * 5/2021 Peng ..... G10L 25/30
(Continued)

FOREIGN PATENT DOCUMENTS

CN 1719514 A 1/2006
CN 108182936 A 6/2018
(Continued)

OTHER PUBLICATIONS

K. Han and D. Wang, "Neural Network Based Pitch Tracking in Very Noisy Speech," in IEEE/ACM Transactions on Audio, Speech, and Language Processing, vol. 22, No. 12, pp. 2158-2168, Dec. 2014, doi: 10.1109/TASLP.2014.2363410. (Year: 2014).*
(Continued)

*Primary Examiner* — Bharatkumar S Shah
(74) *Attorney, Agent, or Firm* — Harness, Dickey & Pierce, P.L.C.; Stephen T. Olson

(57) ABSTRACT

Disclosed is a speech synthesis method including: acquiring fundamental frequency information and acoustic feature information from original speech; generating an impulse train from the fundamental frequency information, and inputting it to a harmonic time-varying filter; inputting the acoustic feature information into a neural network filter estimator to obtain corresponding impulse response information; generating noise signal by a noise generator; determining, by the harmonic time-varying filter, harmonic component information through filtering processing on the impulse train and the impulse response information; determining, by a noise time-varying filter, noise component information based on the impulse response information and the noise; and generating a synthesized speech from the harmonic component information and the noise component information. Acoustic features are processed to obtain corresponding impulse response information, and harmonic
(Continued)

component information and noise component information are modeled respectively, thereby reducing computation of speech synthesis and improving the quality of the synthesized speech.

10 Claims, 4 Drawing Sheets

(58) Field of Classification Search
USPC ..... 704/259
See application file for complete search history.

(56) References Cited

U.S. PATENT DOCUMENTS

| | | | | |
|---|---|---|---|---|
| 11,410,684 | B1 * | 8/2022 | Klimkov | G10L 25/78 |
| 2003/0200092 | A1 | 10/2003 | Gao et al. | |
| 2006/0064301 | A1 | 3/2006 | Aguilar et al. | |
| 2013/0262098 | A1 | 10/2013 | Kim et al. | |
| 2014/0025382 | A1 | 1/2014 | Chen et al. | |
| 2018/0174571 | A1 * | 6/2018 | Tamura | G10L 13/047 |

FOREIGN PATENT DOCUMENTS

| | | | |
|---|---|---|---|
| CN | 108986834 | A | 12/2018 |
| CN | 109360581 | A | 2/2019 |
| CN | 109767750 | A | 5/2019 |
| CN | 110085245 | A | 8/2019 |
| CN | 110349588 | A | 10/2019 |
| CN | 110473567 | A | 11/2019 |
| CN | 111048061 | A | 4/2020 |
| CN | 111128214 | A | 5/2020 |
| CN | 111833843 | A | 10/2020 |
| GB | 2546981 | A | 8/2017 |

OTHER PUBLICATIONS

P. K. Lehana, R. K. Gupta and S. Kumari, "Enhancement of esophagus speech using harmonic plus noise model," 2004 IEEE Region 10 Conference Tencon 2004., Chiang Mai, Thailand, 2004, pp. 669-672 vol. 1, doi: 10.1109/TENCON.2004.1414509. (Year: 2004).*

C. Valentini-Botinhao and J. Yamagishi, "Speech Enhancement of Noisy and Reverberant Speech for Text-to-Speech," in IEEE/ACM Transactions on Audio, Speech, and Language Processing, vol. 26, No. 8, pp. 1420-1433, Aug. 2018, doi: 10.1109/TASLP.2018.2828980. (Year: 2018).*

K. Han and D. Wang, "Neural Network Based Pitch Tracking in Very Noisy Speech," in IEEE/ACM Transactions on Audio, Speech, and Language Processing, vol. 22, No. 12, pp. 2158-2168, Dec. 2014, doi: 10.1109/TASLP.2014.2363410. (Year: 2014) (Year: 2014).*

R. K. Gupta and S. Kumari, "Enhancement of esophagus speech using harmonic plus noise model," 2004 IEEE Region 10 Conference Tencon 2004., Chiang Mai, Thailand, 2004, pp. 669-672 vol. 1, doi: 10.1109/TENCON.2004.1414509. (Year: 2004) ( Year: 2004).*

European Search Report regarding Patent Application No. 21846547, dated Jun. 14, 2023.

Atkinson I A et al: "Time Envelope Vocoder, a New LP Based Coding Strategy for Use At Bit Rates of 2.5 KB/S and Below", IEEE Journal On Selected Areas in Communications, IEEE Service Center, Piscataway, US, vol. 13, No. 2, Feb. 1, 1995 (Feb. 1, 1995), pp. 449-457, XP000489310, ISSN: 0733-8716, DOI: 10.1109/49.345890.

International Search Report (English and Chinese) and Written Opinion of the International Searching Authority (Chinese) issued in PCT/CN2021/099135, dated Aug. 30, 2021; ISA/CN.

* cited by examiner

SPEECH SYNTHESIS METHOD AND SYSTEM

CROSS-REFERENCE TO RELATED APPLICATIONS

This application is a U.S. National Phase Application under 35 U.S.C. 371 of International Application No. PCT/CN2021/099135, filed on Jun. 9, 2021, which claims the benefit of Chinese Patent Application No. 202010706916.4, filed on Jul. 21, 2020. The entire disclosures of the above applications are incorporated herein by reference.

TECHNICAL FIELD

The present disclosure relates to the technical field of artificial intelligence, and in particular, to a speech synthesis method and system.

BACKGROUND

Generative neural networks have obtained tremendous success in generating high-fidelity speech and other audio signals. Audio generation models conditioned on speech features such as log-Mel spectrograms can be used as vocoders. Neural vocoders have greatly improved the synthesis quality of modern text-to-speech systems. Auto-regressive models, including WaveNet and WaveRNN, generate an audio sample at a time conditioned on all previously generated samples. Flow-based models, including Parallel WaveNet, ClariNet, WaveGlow and FloWaveNet, generate audio samples in parallel with invertible transformations. GAN-based models, including GAN-TTS, Parallel WaveGAN, and Mel-GAN, are also capable of parallel generation. Instead of being trained with maximum likelihood, they are trained with adversarial loss functions.

Neural vocoders can be designed to include speech synthesis models in order to reduce computational complexity and further improve synthesis quality. Many models aim to improve source signal modeling in a source-filter model, including LPC-Net, GELP, GlotGAN. They only generate source signals (e.g., linear prediction residual signal) with neural networks while offloading spectral shaping to time-varying filters. Instead of improving source signal modeling, the neural source-filter (NSF) framework replaces linear filters in the classical model with convolutional neural network based filters. NSF can synthesize waveform by filtering a simple sine-based excitation signal. However, when using the above prior art to perform speech synthesis, a large amount of computation is required, and the quality of the synthesized speech is low.

SUMMARY OF THE INVENTION

Embodiments of the present disclosure provide a speech synthesis method and system to solve at least one of the above technical problems.

In a first aspect, an embodiment of the present disclosure provides a speech synthesis method, applied to an electronic device and including:

acquiring fundamental frequency information and acoustic feature information from an original speech;

generating an impulse train based on the fundamental frequency information, and inputting the impulse train to a harmonic time-varying filter;

inputting the acoustic feature information into a neural network filter estimator to obtain corresponding impulse response information;

generating, by a noise generator, a noise signal;

determining, by the harmonic time-varying filter, harmonic component information by performing filtering processing based on the input impulse train and the impulse response information;

determining, by a noise time-varying filter, noise component information based on the input impulse response information and the noise; and generating a synthesized speech based on the harmonic component information and the noise component information.

In a second aspect, an embodiment of the present disclosure provides a speech synthesis system, applied to an electronic device and including:

an impulse train generator configured to generate an impulse train based on fundamental frequency information of an original speech;

a neural network filter estimator configured to obtain corresponding impulse response information by taking acoustic feature information of the original speech as input;

a random noise generator configured to generate a noise signal;

a harmonic time-varying filter configured to determine harmonic component information by performing filtering processing based on the input impulse train and the impulse response information;

a noise time-varying filter configured to determine noise component information based on the input impulse response information and the noise; and an impulse response system configured to generate a synthesized speech based on the harmonic component information and the noise component information.

In a third aspect, an embodiment of the present disclosure provides a storage medium, in which one or more programs including execution instructions are stored. The execution instructions can be read and executed by an electronic device (including but not limited to a computer, a server, or a network device, etc.), so as to perform any of the above speech synthesis method according to the present disclosure.

In a fourth aspect, an electronic device is provided, including at least one processor, and a memory communicatively coupled to the at least one processor. The memory stores instructions executable by the at least one processor to enable the at least one processor to perform any of the above speech synthesis method according to the present disclosure.

In a fifth aspect, an embodiment of the present disclosure also provides a computer program product, including a computer program stored in a storage medium. The computer program includes program instructions, which, when being executed by a computer, enable the computer to perform any of the above speech synthesis method.

The beneficial effects of the embodiments of the present disclosure lie in that: acoustic features are processed by a neural network filter estimator to obtain corresponding impulse response information, and harmonic component information and noise component information are modeled by a harmonic time-varying filter and a noise time-varying filter respectively, thereby reducing the amount of computation of speech synthesis and improving the quality of the synthesized speech.

BRIEF DESCRIPTION OF THE DRAWINGS

In order to illustrate the technical solutions of the embodiments of the present disclosure more clearly, a brief description of the accompanying drawings used in the description of the embodiments will be given as follows. Obviously, the accompanying drawings are some embodiments of the present disclosure, and those skilled in the art can also obtain other drawings based on these drawings without any creative effort.

DETAILED DESCRIPTION OF THE EMBODIMENTS

Figure 1:
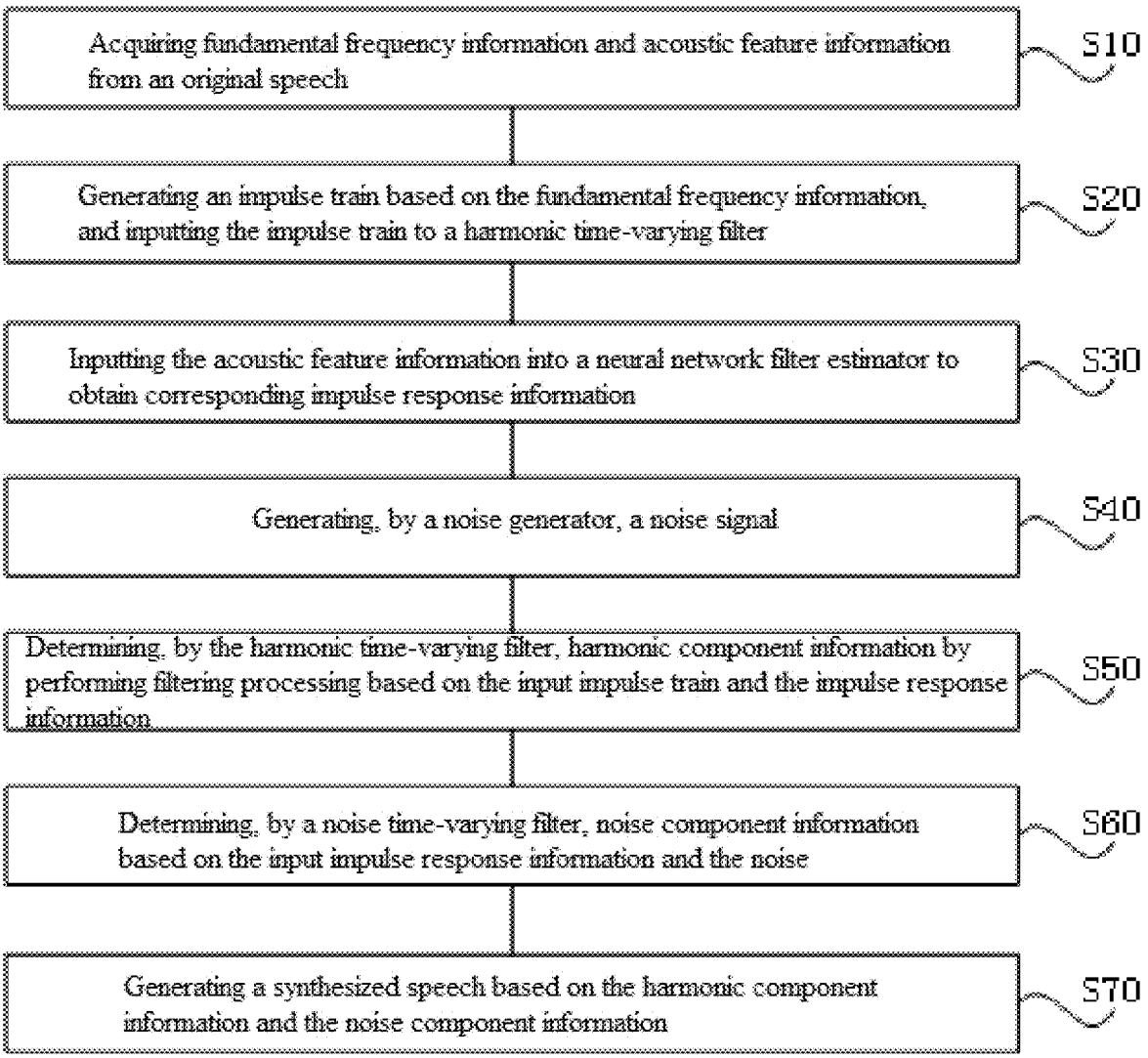
FIG. 1 is a flowchart of a speech synthesis method according to an embodiment of the present disclosure.

In order to make the objectives, technical solutions and advantages of the embodiments of the present disclosure clearer, the technical solutions in the embodiments of the present disclosure will be described clearly and completely below with reference to the accompanying drawings in the embodiments of the present disclosure. Obviously, only some but not all embodiments of the present disclosure have been described. All other embodiments obtained by those skilled in the art based on these embodiments without creative efforts shall fall within the protection scope of the present disclosure.

It should be noted that the embodiments in the present application and the features in these embodiments can be combined with each other when no conflict exists.

The present application can be described in the general context of computer-executable instructions such as program modules executed by a computer. Generally, program modules include routines, programs, objects, elements, and data structures, etc. that performs specific tasks or implement specific abstract data types. The present application can also be practiced in distributed computing environments in which tasks are performed by remote processing devices connected through a communication network. In a distributed computing environment, program modules may be located in local and remote computer storage media including storage devices.

In the present application, "module", "system", etc. refer to related entities applied in a computer, such as hardware, a combination of hardware and software, software or software under execution, etc. In particular, for example, an element may be, but is not limited to, a process running on a processor, a processor, an object, an executable element, an execution thread, a program, and/or a computer. Also, an application program or a script program running on the server or the server may be an element. One or more elements can be in the process and/or thread in execution, and the elements can be localized in one computer and/or distributed between two or more computers and can be executed by various computer-readable media. Elements can also conduct communication through local and/or remote process based on signals comprising one or more data packets, for example, a signal from data that interacts with another element in a local system or a distributed system, and/or a signal from data that interacts with other systems through signals in a network of the internet.

Finally, it should also be noted that, wordings like first and second are merely for separating one entity or operation from the other, but not intended to require or imply a relation or sequence among these entities or operations. Further, it should be noted that in this specification, terms such as "comprised of" and "comprising" shall mean that not only those elements described thereafter, but also other elements not explicitly listed, or elements inherent to the described processes, methods, objects, or devices, are included. In the absence of specific restrictions, elements defined by the phrase "comprising . . . " do not mean excluding other identical elements from process, method, article or device involving these mentioned elements.

The present disclosure provides a speech synthesis method applicable to an electronic device. The electronic device may be a mobile phone, a tablet computer, a smart speaker, a video phone, etc., which is not limited in the present disclosure.

As shown in FIG. 1, an embodiment of the present disclosure provides a speech synthesis method applicable to an electronic device, which includes the following steps.

In S10, fundamental frequency information and acoustic feature information are acquired from an original speech.

In an exemplary embodiment, the fundamental frequency refers to the lowest and usually strongest frequency in a complex sound, often considered to be the fundamental pitch of the sound. The acoustic feature may be MFCC, PLP or CQCC, etc., which is not limited in the present disclosure.

In S20, an impulse train is generated based on the fundamental frequency information and input to a harmonic time-varying filter.

In S30, the acoustic feature information is input to a neural network filter estimator to obtain corresponding impulse response information.

In S40, a noise signal is generated by a noise generator.

In S50, the harmonic time-varying filter performs filtering processing based on the input impulse train and the impulse response information to determine harmonic component information.

In S60, a noise time-varying filter determines noise component information based on the input impulse response information and the noise.

In S70, a synthesized speech is generated based on the harmonic component information and the noise component information.

In an exemplary embodiment, the harmonic component information and the noise component information are input to a finite-length mono-impulse response system to generate the synthesized speech.

In an exemplary embodiment, at least one of the harmonic time-varying filter, the neural network filter estimator, the noise generator, and the noise time-varying filter is preconfigured in the electronic device according to the present disclosure.

According to the embodiment of the present disclosure, in the electronic device, fundamental frequency information and acoustic feature information are firstly acquired from an original speech. An impulse train is generated based on the fundamental frequency information and input to a harmonic time-varying filter. An acoustic feature information is input into a neural network filter estimator to obtain corresponding impulse response information, and a noise signal is generated by a noise generator. The harmonic time-varying filter conducts filters processing on the input impulse train and the impulse response information to determine harmonic component information. A noise time-varying filter determines noise component information based on the input impulse response information and the noise, A synthesized speech is thus generated based on the harmonic component information and the noise component information. In the above electronic device according to the embodiment of the present invention, acoustic features are processed by a neural network filter estimator to obtain corresponding impulse response information, with a modeling of harmonic component information and noise component information respectively by a harmonic time-varying filter and a noise time-varying filter, thereby reducing the computation of speech synthesis and improving the quality of the synthesized speech.

In some embodiments, the neural network filter estimator includes a neural network unit and an inverse discrete-time Fourier transform unit. In an exemplary embodiment, the neural network filter estimator in the electronic device includes a neural network unit and an inverse discrete-time Fourier transform unit. In some embodiments, for step S30, inputting the acoustic feature information to the neural network filter estimator in the electronic device to obtain the corresponding impulse response information includes:

inputting the acoustic feature information to the neural network unit of the electronic device for analysis to obtain first complex cepstral information corresponding to harmonics and second complex cepstral information corresponding to noise; and converting, by the inverse discrete-time Fourier transform unit of the electronic device, the first complex cepstral information and the second complex cepstral information into first impulse response information corresponding to harmonics and second impulse response information corresponding to noise, respectively.

In the embodiment of the present application, through the neural network unit and the inverse discrete-time Fourier transform unit of the electronic device, the complex cepstrum is used as the parameter of a linear time-varying filter, and the complex cepstrum is estimated with a neural network, which gives the time-varying filter a controllable group delay function, thereby improving the quality of speech synthesis and reducing the computation.

In an exemplary embodiment, the harmonic time-varying filter of the electronic device determines the harmonic component information by performing filtering processing based on the input impulse train and the impulse response information, which is conducted based on the input impulse train and the first impulse response information.

In an exemplary embodiment, the noise time-varying filter of the electronic device determines the noise component information based on the input impulse response information and the noise, which is conducted based on the input second impulse response information and the noise.

It should be noted that the foregoing embodiments of method are described as a combination of a series of actions for the sake of brief description. Those skilled in the art could understand that the application is not restricted by the order of actions as described, because some steps may be carried out in other order or simultaneously in the present application. Further, it should also be understood by those skilled in the art that the embodiments described in the description are preferable, and hence some actions or modules involved therein are not essential to the present application. Particular emphasis is given for respective embodiment in descriptions, hence for those parts not described specifically in an embodiment reference can be made to other embodiments for relevant description.

Figure 2:
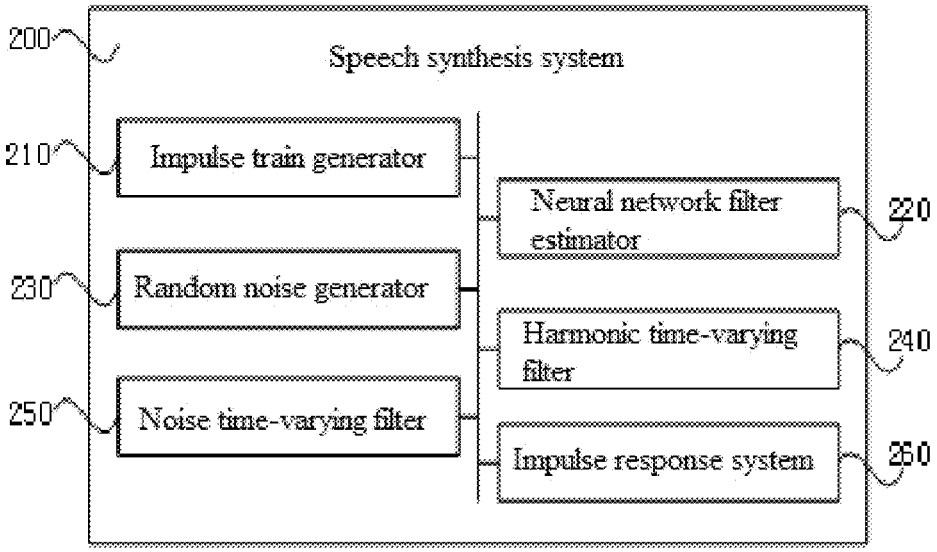
FIG. 2 is a schematic block diagram of a speech synthesis system according to an embodiment of the present disclosure.

As shown in FIG. 2, the present disclosure provides a speech synthesis system 200 applicable to an electronic device, including:

an impulse train generator 210 configured to generate an impulse train based on fundamental frequency information of an original speech;

a neural network filter estimator 220 configured to obtain corresponding impulse response information by taking acoustic feature information of the original speech as input;

a random noise generator 230 configured to generate a noise signal;

a harmonic time-varying filter 240 configured to determine harmonic component information by performing filtering processing based on the input impulse train and the impulse response information;

a noise time-varying filter 250 configured to determine noise component information based on the input impulse response information and noise; and an impulse response system 260 configured to generate a synthesized speech based on the harmonic component information and the noise component information.

In the above embodiments, acoustic features are processed by a neural network filter estimator to obtain corresponding impulse response information, with a modeling of harmonic component information and noise component information by a harmonic time-varying filter and a noise time-varying filter respectively, thereby reducing the computation of speech synthesis and improving the quality of the synthesized speech.

In some embodiments, the neural network filter estimator comprises a neural network unit and an inverse discrete-time Fourier transform unit.

The acoustic feature information of the original speech is input into the neural network filter estimator to obtain the corresponding impulse response information, which comprises:

inputting the acoustic feature information to the neural network unit for analysis to obtain first complex cepstral information corresponding to harmonics and second complex cepstral information corresponding to noise; and converting, by the inverse discrete-time Fourier transform unit, the first complex cepstral information and the second complex cepstral information into first impulse response information corresponding to harmonics and second impulse response information corresponding to noise.

In an exemplary embodiment, the inverse discrete-time Fourier transform unit includes a first inverse discrete-time Fourier transform subunit and a second inverse discrete-time Fourier transform subunit. The first inverse discrete-time Fourier transform subunit is configured to convert first complex cepstral information into first impulse response information corresponding to harmonics. The second inverse discrete-time Fourier transform subunit is configured to convert second complex cepstral information into second impulse response information corresponding to noise.

In some embodiments, the harmonic time-varying filter determines the harmonic component information by performing filtering processing on the input impulse train and the first impulse response information. The noise time-varying filter determines the noise component information based on the input second impulse response information and the noise.

In some embodiments, the speech synthesis system adopts the following optimized training method before speech synthesis: the speech synthesis system is trained using a multi-resolution STFT loss and an adversarial loss for the original speech and the synthesized speech.

In some embodiments, an embodiment of the present disclosure further provides an electronic device, including:

an impulse train generator configured to generate an impulse train based on fundamental frequency information of an original speech;

a neural network filter estimator configured to obtain corresponding impulse response information by taking acoustic feature information of the original speech as input;

a random noise generator configured to generate a noise signal;

a harmonic time-varying filter configured to determine harmonic component information by performing filtering processing based on the input impulse train and the impulse response information;

a noise time-varying filter configured to determine noise component information based on the input impulse response information and the noise; and an impulse response system configured to generate a synthesized speech based on the harmonic component information and the noise component information.

In the above embodiment of the present invention, acoustic features are processed by a neural network filter estimator to obtain corresponding impulse response information, with a modeling of harmonic component information and noise component information respectively by a harmonic time-varying filter and a noise time-varying filter, thereby reducing the computation of speech synthesis and improving the quality of the synthesized speech.

In some embodiments, the neural network filter estimator includes a neural network unit and an inverse discrete-time Fourier transform unit.

The corresponding impulse response information is obtained by taking the acoustic feature information of the original speech as input, which includes:

inputting the acoustic feature information to the neural network unit for analysis to obtain first complex cepstral information corresponding to harmonics and second complex cepstral information corresponding to noise; and converting, by the inverse discrete-time Fourier transform unit, the first complex cepstral information and the second complex cepstral information into first impulse response information corresponding to harmonics and second impulse response information corresponding to noise, respectively.

In an exemplary embodiment, the inverse discrete-time Fourier transform unit includes a first inverse discrete-time Fourier transform subunit and a second inverse discrete-time Fourier transform subunit. The first inverse discrete-time Fourier transform subunit is configured to convert the first complex cepstral information into first impulse response information corresponding to harmonics. The second inverse discrete-time Fourier transform subunit is configured to convert the second complex cepstral information into second impulse response information corresponding to noise.

In some embodiments, the harmonic component information is determined by performing filtering processing on the input impulse train and the impulse response information, which is implemented by determining with the harmonic time-varying filter the harmonic component information by performing filtering processing based on the input impulse train and the first impulse response information. The noise component information is determined based on the input impulse response information and the noise, which is implemented by determining with the noise time-varying filter the noise component information based on the input second impulse response information and the noise.

In some embodiments, the speech synthesis system adopts the following optimized training method before being used for speech synthesis: the speech synthesis system is trained using a multi-resolution STFT loss and an adversarial loss for the original speech and the synthesized speech.

An embodiments of the present disclosure also provides an electronic device, including at least one processor and a memory communicatively connected thereto, the memory storing instructions executable by the at least one processor to implement the following method:

acquiring fundamental frequency information and acoustic feature information from an original speech; generating an impulse train based on the fundamental frequency information, and inputting the impulse train to a harmonic time-varying filter; inputting the acoustic feature information into a neural network filter estimator to obtain corresponding impulse response information; generating, by a noise generator, a noise signal; determining, by the harmonic time-varying filter, harmonic component information by performing filtering processing based on the input impulse train and the impulse response information; determining, by a noise time-varying filter, noise component information based on the input impulse response information and the noise; and generating a synthesized speech based on the harmonic component information and the noise component information.

In an exemplary embodiment, the harmonic component information and the noise component information are input to a finite-length mono-impulse response system to generate the synthesized speech.

In some embodiments, the neural network filter estimator comprises a neural network unit and an inverse discrete-time Fourier transform unit.

The acoustic feature information of the original speech is input into the neural network filter estimator to obtain the corresponding impulse response information, which comprises:

inputting the acoustic feature information to the neural network unit for analysis to obtain first complex cepstral information corresponding to harmonics and second complex cepstral information corresponding to noise; and converting, by the inverse discrete-time Fourier transform unit, the first complex cepstral information and the second complex cepstral information into first impulse response information corresponding to harmonics and second impulse response information corresponding to noise.

In an exemplary embodiment, the inverse discrete-time Fourier transform unit includes a first inverse discrete-time Fourier transform subunit and a second inverse discrete-time Fourier transform subunit. The first inverse discrete-time Fourier transform subunit is configured to convert the first complex cepstral information into first impulse response information corresponding to harmonics. The second inverse discrete-time Fourier transform subunit is configured to convert the second complex cepstral information into second impulse response information corresponding to noise.

In some embodiments, the harmonic component information is determined by performing filtering processing on the input impulse train and the impulse response information, which is implemented by determining with the harmonic time-varying filter the harmonic component information by performing filtering processing based on the input impulse train and the first impulse response information. The noise component information is determined based on the input impulse response information and the noise, which is implemented by determining with the noise time-varying filter the noise component information based on the input second impulse response information and the noise.

In some embodiments, the speech synthesis system adopts the following optimized training method before being used for speech synthesis: the speech synthesis system is trained using a multi-resolution STFT loss and an adversarial loss for the original speech and the synthesized speech.

In some embodiments, a non-transitory computer-readable storage medium is provided in which one or more programs including execution instructions is stored. The execution instructions can be read and executed by an electronic device (including but not limited to a computer, a server, or a network device, etc.) to implement any of the above speech synthesis method according to the present disclosure.

In some embodiments, a computer program product is also provided, including a computer program stored in a non-volatile computer-readable storage medium. The computer program includes program instructions executable by a computer to cause the computer to perform any of the above speech synthesis method.

In some embodiments, a storage medium is also provided, on which a computer program is stored. The program, when being executed by a processor, implements the speech synthesis method according to the embodiment of the present disclosure.

The speech synthesis system according to the above embodiment may be applied to execute the speech synthesis method according to the embodiment of the present disclosure, and correspondingly achieves the technical effect of implementing the speech synthesis method according to the above embodiment of the present disclosure, which will not be repeated here. In the embodiment of the present disclosure, relevant functional modules may be implemented by a hardware processor.

In order to more clearly illustrate the technical solution of the present disclosure and to more directly prove the practicability of the present disclosure and its benefit relative to the prior art, the technical background, technical solutions and experiments of the present disclosure will be described hereinafter.

Abstract: In the present disclosure, a neural homomorphic vocoder (NHV) is provided, which is a source-filter model based neural vocoderframework. NHV synthesizes speech by filtering impulse trains and noise with linear time-varying (LTV) filters. A neural network controls the LTV filters by estimating complex cepstrums of time-varying impulse responses given acoustic features. The proposed framework can be trained with a combination of multi-resolution STFT loss and adversarial loss functions. Due to the use of DSP-based synthesis methods, NHV is highly efficient, fully controllable and interpretable. A vocoder was built under the framework to synthesis speech given log-Mel spectrograms and fundamental frequencies. While the model costs only 15 kFLOPs per sample, the synthesis quality remained comparable to baseline neural vocoders in both copy-synthesis and text-to-speech.

1. Introduction

Neural audio synthesis with sinusoidal models is explored recently. DDSP proposes to synthesize audio by controlling a Harmonic plus Noise model with a neural network. In DDSP, the harmonic component is synthesized with additive synthesis where sinusoids with time-varying amplitude are added. And the noise component is synthesized with linear time-varying filtered noise. DDSP has been proved successful in modeling musical instruments. In this work, integration of DSP components in neural vocoders is further explored.

A novel neural vocoder framework called neural homomorphic vocoder is proposed, which synthesizes speech with source-filter models controlled by a neural network. It is demonstrated that with a shallow CNN containing 0.6 million parameters, a neural vocoder capable of reconstructing high-quality speech from log-Mel spectrograms and fundamental frequencies can be built. While the computational complexity is more than 100 times lower compared to baseline systems, the quality of generated speech remains comparable. Audio samples and further information are provided in the online supplement. It is highly recommended to listen to the audio samples.

2. Neural Homomorphic Vocoder

Figure 3:
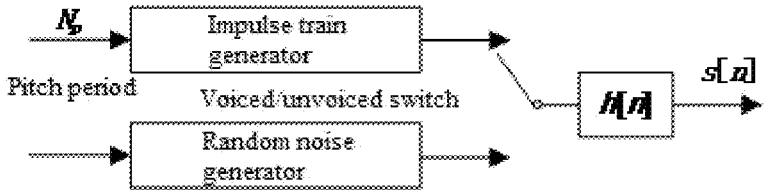
FIG. 3 is a discrete-time simplified source-filter model adopted in an embodiment of the present disclosure.

FIG. 3 is a simplified source-filter model in discrete time according to an embodiment of the present disclosure. e [n] is source signal, s [n] is speech.

The source-filter model is a widely applied linear model for speech production and synthesis. A simplified version of the source-filter model is demonstrated in FIG. 3. The linear filter h[n] describes the combined effect of glottal pulse, vocal tract, and radiation in speech production. The source signal e[n] is assumed to be either a periodic impulse train p[n] in voiced speech, or noise signal u[n] in unvoiced speech. In practice, e[n] can be a multi-band mixture of impulse and noise. $N_p$ is time-varying. And h[n] is replaced with a linear time-varying filter.

In neural homomorphic vocoder (NHV), a neural network controls linear time-varying (LTV) filters in source-filter models. Similar to the Harmonic plus Noise model, NHV generates harmonic and noise components separately. The harmonic component, which contains periodic vibrations in voiced sounds, is modeled with LTV filtered impulse trains. The noise component, which includes background noise, unvoiced sounds, and the stochastic component in voiced sounds, is modeled with LTV filtered noise.

In the following discussion, original speech signal x and reconstructed signal s are assumed to be divided into non-overlapping frames with frame length L. We define m as the frame index, n as the discrete time index, and c as the feature index. The total number of frames M and total number of sampling points N follow $N=M\times L$. In $f_0$, S, $h_h$, $h_n$, $0\leq m<M-1$. x, s, p, u, $s_h$, $s_n$ are finite duration signals, in which $0\leq n<N-1$. Impulse responses $h_h$, $h_n$ and h are infinite long signals, in which $n\in Z$.

Figure 4:
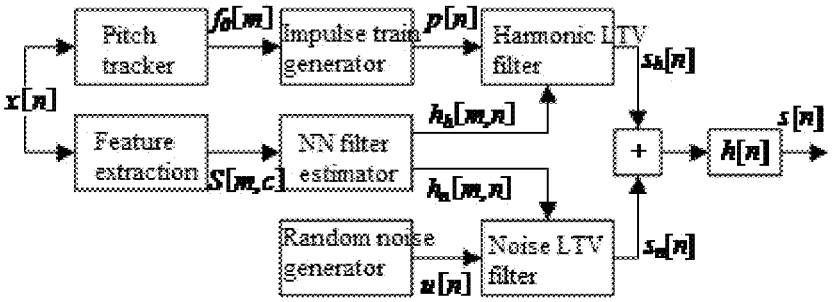
FIG. 4 is a schematic diagram of speech synthesis using a neural homomorphic vocoder according to an embodiment of the present disclosure.

FIG. 4 is an illustration of NHV in speech synthesis according to an embodiment of the present disclosure. First, the impulse train p[n] is generated from frame-wise fundamental frequency $f_0[m]$. And the noise signal u[n] is sampled from a Gaussian distribution. Then, the neural network estimates impulse responses $h_h[m, n]$ and $h_n[m, n]$ in each frame, given the log-Mel spectrogram S[m, c]. Next, the impulse train p[n] and the noise signal u[n] are filtered by LTV filters to obtain harmonic component $s_h[n]$ and noise component $s_n[n]$. Finally, $s_h[n]$ and $s_n[n]$ are added together and filtered by a trainable FIR h[n] to obtain s[n].

Figure 5:
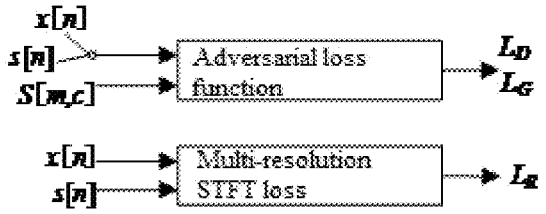
FIG. 5 is a schematic diagram of a loss function used for training a neural homomorphic vocoder according to an embodiment of the present disclosure.

FIG. 5 is an illustration of the loss functions used to train NHV according to an embodiment of the present disclosure. In order to train the neural network, multi-resolution STFT loss $L_R$, and adversarial losses $L_Q$ and $L_D$ are computed from x[n] and s[n], as illustrated in FIG. 5. Since LTV filters are fully differentiable, gradients can propagate back to the NN filter estimator.

In the following sections, we further describe different components in the NHV framework.

2.1. Impulse Train Generator

Many methods exist for generating alias-free discrete time impulse trains. Additive synthesis is one of the most accurate methods. As described in equation (1), a low-passed sum of sinusoids can be used to generate an impulse train. $f_0$ (t) is reconstructed from $f_0[m]$ with zero-order hold or linear interpolation. $p[n]=p(n/f_s)$. $f_s$ is the sampling rate.

$$p(t) = \begin{cases} \sum_{n=1}^{2nf_0(t)<f_s} \cos\left(\int_0^t 2\pi n \quad f_0(\tau)d\tau\right), & \text{if } f_0(t) > 0 \\ 0, & \text{if } f_0(t) = 0 \end{cases} \tag{1}$$

Additive synthesis can be computationally expensive as it requires summing up about 200 sine functions at the sampling rate. The computational complexity can be reduced with approximations. For example, we can round the fundamental periods to the nearest multiples of the sampling period. In this case, the discrete impulse train is sparse. It can then be generated sequentially, one pitch mark at a time.

2.2. Neural Network Filter Estimator

Figure 6:
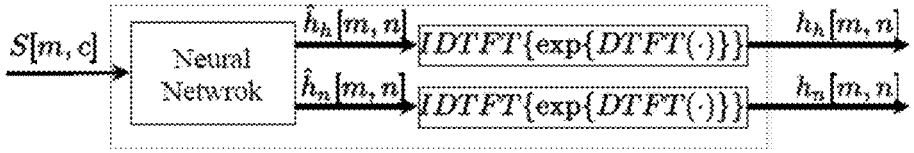
FIG. 6 is a schematic structural diagram of a neural network filter estimator according to an embodiment of the present disclosure.

FIG. 6 is a structural diagram of a neural network filter estimator according to an embodiment of the present disclosure, in which NN output is defined to be complex cepstrums.

It is proposed to use complex cepstrums ($\tilde{h}_h$ and $\tilde{h}_n$) as the internal description of impulse responses ($h_h$ and $h_n$). The generation of impulse responses is illustrated in FIG. 6.

Complex cepstrums describe the magnitude response and the group delay of filters simultaneously. The group delay of filters affects the timbre of speech. Instead of using linear-phase or minimum-phase filters, NHV uses mixed-phase filters, with phase characteristics learned from the dataset.

Restricting the length of a complex cepstrum is equivalent to restricting the levels of detail in the magnitude and phase response. This gives an easy way to control the filters complexity. The neural network only predicts low-frequency coefficients. The high-frequency cepstrum coefficients are set to zero. In some experiments, two 10 ms long complex cepstrums are predicted in each frame.

In the implementation, the DTFT and IDTFT must be replaced with DFT and IDFT. And IIRs, i.e., $h_h$ [m, n] and $h_n$ [m, n], must be approximated by FIRs. The DFT size should be sufficiently large to avoid serious aliasing. N=1024 is a good choice for this purpose.

2.3. LTV Filters and Trainable FIRs

The harmonic LTV filter is defined in equation (3). The noise LTV filter is defined similarly. The convolutions can be carried out in either time domain or frequency domain. The filtering process of the harmonic component is illustrated in FIG. 7.

$$w_L[n] \triangleq \begin{cases} 1, & 0 \le n \le L-1 \\ 0, & \text{otherwise} \end{cases} \tag{2}$$

$$s_h[n] = \sum_{m=0}^{m<M} (w_L[n - \text{mL}] \cdot p[n]) * h_h[m, n] \tag{3}$$

Figure 7:
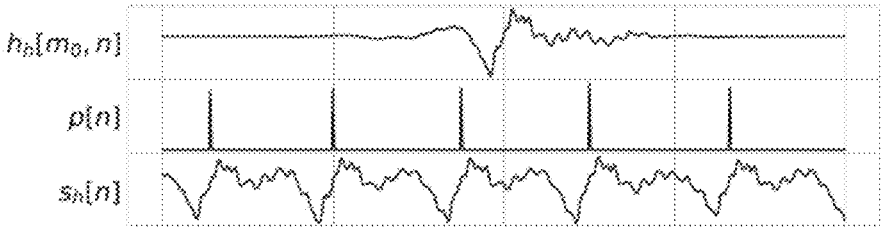
FIG. 7 shows a filtering process of harmonic components in an embodiment of the present disclosure.

FIG. 7: Signals sampled from a trained NHV model around frame $m_0$. The figure shows 512 sampling points, or 4 frames. Only one impulse response $h_h$ [$m_0$, n] from frame $m_0$ is plotted.

As proposed in DDSP, an exponentially decayed trainable causal FIR h[n] is applied at the last step in speech synthesis. The convolution $(s_h[n]+s_n[n])*h[n]$ is carried out in the frequency domain with FFT to reduce computational complexity.

2.4. Neural Network Training 2.4.1. Multi-Resolution STFT Loss

Point-wise loss between x [n] and s [n] cannot be applied to train the model, as it requires glottal closure instants (GCIs) in x and s to be fully aligned. Multi-resolution STFT loss is tolerant of phase mismatch in signals. Suppose there were C different STFT configurations, $0 \le i < C$. Given original signal x, and reconstruction s, their STFT amplitude spectrograms calculated with configuration i are $X_i$ and $S_i$, each containing $K_i$ values. In NHV, a combination of the $L^1$ norm of amplitude and log-amplitude distances was used. The reconstruction loss $L_R$ is the sum of all distances under all configurations.

$$L_R = \frac{1}{C}\sum_{i=0}^{i<C} \frac{1}{K_i}(\|X_i - S_i\|_1 + \|\log X_i - \log S_i\|_2) \tag{4}$$

It was found that using more STFT configurations leads to fewer artifacts in output speech. Hanning windows with sizes (128, 256, 384, 512, 640, 768, 896, 1024, 1536, 2048, 3072, 4096) were used, with 75% overlap. The FFT sizes are set to twice the window sizes.

2.4.2. Adversarial Loss Functions

NHV relies on adversarial loss functions with waveform input to learn temporal fine structures in speech signals. Although it is not necessary for adversarial loss functions to guarantee periodicity in NHV, they still help ensure phase similarity between s[n] and x [n]. The discriminator should give separate decisions for different short segments in the input signal. The discriminator used in the experiments is a WaveNet conditioned on log-Mel spectrograms. Details of discriminator structure can be found in section 3. The hinge loss version of the GAN objective was used in the experiments.

$$L_D = \mathbb{E}_{x,S}[\max(0,1-D(x,S))] + \mathbb{E}_{f_0,S}[\max(0,1-D(G(f_0,S),S))] \tag{5}$$

$$L_G = \mathbb{E}_{f_0,S}[-D(G(f_0,S),S)] \tag{6}$$

D(x, S) is the discriminator network. D takes original signal x or reconstructed signal s, and ground truth log-Mel spectrogram S as input, $f_0$ is the fundamental frequency. S is the log-Mel spectrogram. $G(f_0, S)$ outputs reconstructed signal s. It includes the source signal generation, filter estimation and LTV filtering process in NHV. The discriminator is trained to classify x as real and s as fake by minimizing $L_D$. And the generator is trained to deceive the discriminator by minimizing $L_G$.

3. Experiments

To verify the effectiveness of the proposed vocoder framework, a neural vocoder was built and compared its performance in copy synthesis and text-to-speech with various baseline models.

3.1. Corpus and Feature Extraction

All vocoders and TTS models were trained on the Chinese Standard Mandarin Speech Corpus (CSMSC). CSMSC contains 10000 recorded sentences read by a female speaker, totaling to 12 hours of high-quality speech, annotated with phoneme sequences, and prosody labels. The original signals were sampled at 48 kHz. In the experiments, audios were downsampled to 22050 Hz. The last 100 sentences were reserved as the test set.

All vocoder models were conditioned on band-limited (40-7600 Hz) 80 bands log-Mel spectrograms. The window length used in spectrogram analysis was 512 points (23 ms at 22050 Hz), and the frame shift was 128 points (6 ms at 22050 Hz). The REAPER speech processing tool was used to extract an estimate of the fundamental frequency. The $f_0$ estimations were then refined by StoneMask.

3.2. Model Configurations 3.2.1. Details of Vocoders

Figure 8:
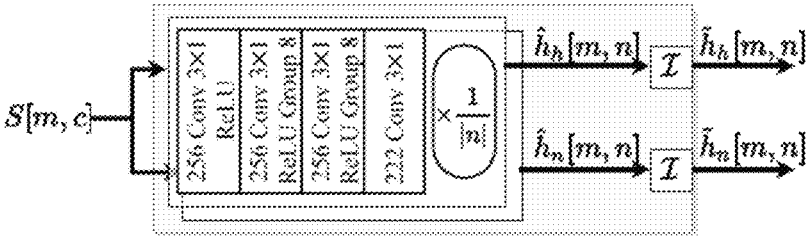
FIG. 8 is a schematic structural diagram of a neural network used in an embodiment of the present disclosure.

FIG. 8 is structural diagram of a neural network according to an embodiment of the present invention. $\mathcal{I}$ is DFT based complex cepstrum inversion. $\tilde{h}_h$ and $\tilde{h}_n$ are DFT approximations of $h_h$ and $h_n$.

In the NHV model, two separate 1D convolutional neural networks with the same structure were used for complex cepstrum estimation, as illustrated in FIG. 8. Note that the outputs of the neural network need to be scaled by $1/|n|$, as natural complex cep strums decay at least as fast as $1/|n|$.

The discriminator was a non-causal WaveNet conditioned on log-Mel spectrograms with 64 skip and residual channels. The WaveNet contained 14 dilated convolutions. The dilation is doubled for every layer up to 64 and then repeated. The kernel sizes in all layers were 3.

A 50 ms exponentially decayed trainable FIR filter was applied to the filtered and mixed harmonic and noise component. It was found that this module made the vocoder more expressive and slightly improved perceived quality.

Several baseline systems were used to evaluate the performance of NHV, including an MoL WaveNet, two variants of the NSF model, and a Parallel WaveGAN. In order to examine the effect of the adversarial loss, an NHV model with only multi-resolution STFT loss (NHV-noadv) was also trained.

The MoLWaveNet pre-trained on CSMSC from ESP-Net (csmsc.wavenet.moLvl) was borrowed for evaluation. The generated audios were downsampled from 24000 Hz to 22050 Hz.

A hn-sinc-NSF model was trained with the released code. The b-NSF model was also reproduced and augmented with adversarial training (b-NSF-adv). The discriminator in b-NSF-adv contained 10 1D convolutions with 64 channels. All convolutions had kernel size 3, with strides following the sequence (2, 2, 4, 2, 2, 2, 1, 1, 1, 1) in each layer. All layers except for the last one were followed by a leaky ReLU activation with a negative slope set to 0.2. STFT window sizes (16, 32, 64, 128, 256, 512, 1024, 2048) and mean amplitude distance were used instead of mean log-amplitude distance described in the paper.

The Parallel WaveGAN model was reproduced. There were several modifications compared to the descriptions in the original paper. The generator was conditioned on log $f_0$, voicing decisions, and log-Mel spectrograms. The same STFT loss configurations in b-NSF-adv were used to train Parallel WaveGAN.

The online supplement contains further details about vocoder training.

3.2.2. Details of the Text-to-Speech Model

A Tacotron2 was trained to predict log $f_0$, voicing decision, and log-Mel spectrogram from texts. The prosody and phonetic labels in CSMSC were both used to produce text input to Tacotron. NHV, Parallel WaveGAN, b-NSF-adv, and hn-sine-NSF were used in TTS quality evaluation. The vocoders were not fine-tuned with generated acoustic features.

3.3. Results and Analysis 3.3.1. Performance in Copy Synthesis

Figure 9:
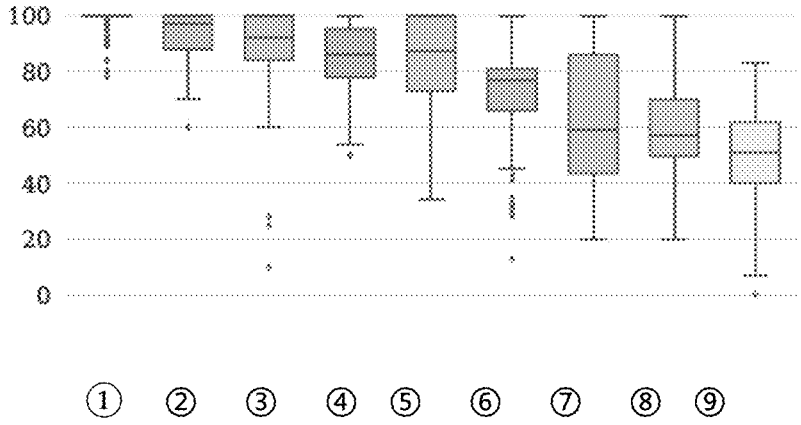
FIG. 9 is a box plot of MUSHRA scores in experiments of the present disclosure.

A MUSHRA test was conducted to evaluate the performance of proposed and baseline neural vocoders in copy synthesis. 24 Chinese listeners participated in the experiment. 18 items unseen during training were randomly selected and divided into three parts. Each listener rated one part out of three. Two standard anchors were used in the test. Anchor35 and Anchor70 represent low-pass filtered original signal with cut-off frequencies of 3.5 kHz and 7 kHz. The box plot of all scores collected is shown in FIG. 9. Abscissas ①-⑨ respectively correspond to: ①—Original, ②—WaveNet, ③—b-NSF-adv, ④—NHV, ⑤—Parallel WaveGAN, ⑥—Anchor70, ①—NHV-noadv, ⑧—hn-sinc-NSF, and ⑨—Anchor35. The mean MUSHRA scores and their 95% confidence intervals can be found in table 1.

TABLE 1

Mean MUSHRA score with 95% CI in copy synthesis

| Model | MUSHRA Score |
|---|---|
| Orignial | 98.4 ± 0.7 |
| WaveNet | 93.0 ± 1.4 |
| b-NSF-adv | 91.4 ± 1.6 |
| NHV | 85.9 ± 1.9 |
| Parallel | 85.0 ± 2.2 |
| Anchor70 | 71.6 ± 2.5 |
| NHV-noadv | 62.7 ± 3.9 |
| hn-sinc-NSF | 58.7 ± 2.9 |
| Anchor35 | 50.0 ± 2.7 |

Wilcoxon signed-rank test demonstrated that except for two pairs (Parallel WaveGAN and NHV with $p=0.4$, hn-sinc-NSF and NHV-noadv with $p=0.3$), all other differences are statistically significant ($p<0.05$). There is a large performance gap between NHV-noadv and NHV model, showing that adversarial loss functions are essential to obtaining high-quality reconstruction.

3.3.2. Performance in Text-to-Speech

To evaluate the performance of vocoders in text-to-speech, a mean opinion score test was performed. 40 Chinese listeners participated in the test. 21 utterances were randomly selected from the test set and were divided into three parts. Each listener finished one part of the test randomly.

TABLE 2

| Mean MOS score with 95% CI in text-to-speech | |
|---|---|
| Model | MOS Score |
| Original | 4.71 ± 0.07 |
| Tacotron2 + hn-sinc-NSF | 2.83 ± 0.11 |
| Tacotron2 + b-NSF-adv | 3.76 ± 0.10 |
| Tacotron2 + Parallel WaveGAN | 3.76 ± 0.12 |
| Tacotron2 + NHV | 3.83 ± 0.09 |

Mann-Whitney U test showed no statistically significant difference between b-NSF-adv, NHV, and Parallel WaveGAN.

3.3.3. Computational Complexity

The required FLOPs per generated sample were reported by different neural vocoders. The complexity of activation functions and computations in feature upsampling and source signal generation were not considered. Filters in NHV are assumed to be implemented with FFT. And N point FFT is assumed to cost 5N log 2N FLOPs.

The Gaussian WaveNet is assumed to have 128 skip channels, 64 residual channels, 24 dilated convolution layers with kernel size set to 3. For b-NSF, Parallel WaveGAN, LPCNet, and MelGAN, hyper-parameters reported in the papers were used for calculation. Further details are provided in the online supplement.

TABLE 3

| FLOPs per sampling point | |
|---|---|
| Model | FLOPs/sample |
| b-NSF | $4. \times 10^6$ |
| Parallel WaveGAN | $2. \times 10^6$ |
| Gaussian WaveNet | $2. \times 10^6$ |
| MelGAN | $4. \times 10^5$ |
| LPCNet | $1.4 \times 10^5$ |
| NHV | $1.5 \times 10^4$ |

As NHV only runs at the frame level, its computational complexity is much lower than models involving a neural network running directly on sampling points.

4. Conclusions

The neural homomorphic vocoder is proposed, which is a neural vocoder framework based on the source-filter model. It is demonstrated that it is possible to build a highly efficient neural vocoder under the proposed framework capable of generating high-fidelity speech.

For future works, it is necessary to identify causes of speech quality degradation in NHV. It was found that the performance of NHV is sensitive to the structure of the discriminator and the design of reconstruction loss. More experiments with different neural network architectures and reconstruction losses may lead to better performance. Future research also includes evaluating and improving the performance of NHV on different corpora.

Figure 10:
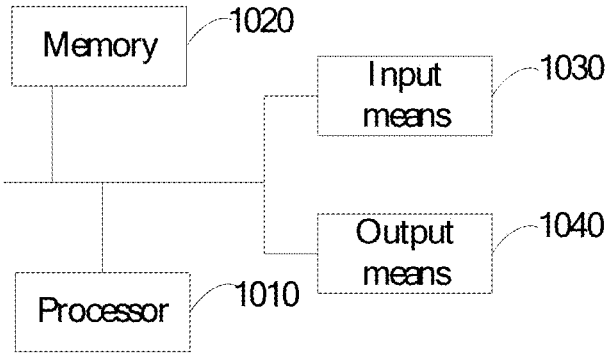
FIG. 10 is a schematic structural diagram of an electronic device according to an embodiment of the present disclosure.

FIG. 10 is a schematic diagram of a hardware structure of an electronic device for performing a speech synthesis method according to another embodiment of the present disclosure. As shown in FIG. 10, the device includes:

one or more processors 1010 and a memory 1020, in which one processor 1010 is taken as an example in FIG. 1.

The device for performing a speech synthesis method may further include an input means 1030 and an output means 1040.

The processor 1010, the memory 1020, the input means 1030, and the output means 1040 may be connected by a bus or in other ways. Bus connection is taken as an example in FIG. 10.

The memory 1020, as a non-volatile computer-readable storage medium, may be used to store non-volatile software programs, non-volatile computer-executable programs and modules, such as program instructions/modules corresponding to the speech synthesis method according to the embodiments of the present disclosure. The processor 1010 executes various functional applications and data processing of a server by running the non-volatile software programs, instructions and modules stored in the memory 1020 to implement the speech synthesis method according to the above method embodiment.

The memory 1020 may include a stored program area and a stored data area. The stored program area may store an operating system and an application program required for at least one function. The stored data area may store data created according to the use of the speech synthesis apparatus, and the like. The memory 1020 may include high speed random access memory and non-volatile memory, such as at least one magnetic disk storage device, flash memory device, or other non-volatile solid state storage device. In some embodiments, the memory 1020 may optionally include a memory located remotely from the processor 1010, which may be connected to the speech synthesis apparatus via a network. Examples of such networks include, but are not limited to, the Internet, an intranet, a local area network, a mobile communication network, and combinations thereof.

The input means 1030 may receive input numerical or character information, and generate signals related to user settings and function control of the speech synthesis apparatus. The output means 1040 may include a display device such as a display screen.

One or more modules are stored in the memory 1020, and perform the speech synthesis method according to any of the above method embodiments when being executed by the one or more processors 1010.

The above product can execute the method provided by the embodiments of the present application, and has functional modules and beneficial effects corresponding to the execution of the method. For technical details not described specifically in the embodiments, reference may be made to the methods provided in the embodiments of the present application.

The electronic device in the embodiments of the present application exists in various forms, including but not limited to:

(1) Mobile communication device which features in its mobile communication function and the main goal thereof is to provide voice and data communication, such as smart phones (such as iPhone), multimedia phones, functional phones, and low-end phones;

(2) Ultra-mobile personal computer device which belongs to the category of personal computers and has computing and processing functions and generally mobile Internet access capability, such as PDA, MID and UMPC devices, e.g., iPad;

(3) Portable entertainment devices which can display and play multimedia content, such as audio and video players (such as iPod), handheld game consoles, e-books, and smart toys and portable car navigation devices;

(4) Server providing computing services and including a processor, hard disk, memory, system bus, etc., with a similar architecture to a general-purpose computer but a higher processing power and stability, reliability, security, scalability, manageability and for providing highly reliable services; and (5) Other electronic devices with data interaction function.

The embodiments of devices described above are only exemplary. The units described as separate components may or may not be physically separated, and the components displayed as units may or may not be physical units, that is, may be located in one place, or it can be distributed to multiple network elements. Some or all of the modules may be selected according to actual needs to achieve the object of the solution of this embodiment.

Through the illustration of the above embodiments, those skilled in the art can clearly understand that each embodiment can be implemented by means of software plus a common hardware platform, and of course, it can also be implemented by hardware. Based on this understanding, the above technical solutions can essentially be embodied in the form of software products that contribute to related technologies, and the computer software products can be stored in computer-readable storage media, such as ROM/RAM, magnetic disks, CD-ROM, etc., including several instructions to enable a computer device (which may be a personal computer, server, or network device, etc.) to perform the method described in each embodiment or some parts of the embodiment.

Lastly, the above embodiments are only intended to illustrate rather than limit the technical solutions of the present disclosure. Although the present disclosure has been described in detail with reference to the foregoing embodiments, those skilled in the art should understand that it is still possible to modify the technical solutions described in the foregoing embodiments, or equivalently substitute some of the technical features. These modifications or substitutions do not make the essence of the corresponding technical solutions depart from the spirit and scope of the technical solutions of the embodiments of the present disclosure.

What is claimed is:

1. A speech synthesis method, applied to an electronic device and comprising:

acquiring fundamental frequency information and acoustic feature information from an original speech;

generating an impulse train based on the fundamental frequency information, and inputting the impulse train to a harmonic time-varying filter;

inputting the acoustic feature information into a neural network filter estimator to obtain corresponding impulse response information;

generating, by a noise generator, a noise signal;

determining, by the harmonic time-varying filter, harmonic component information by performing filtering processing based on the input impulse train and the impulse response information;

determining, by a noise time-varying filter, noise component information based on the input impulse response information and the noise; and generating a synthesized speech based on the harmonic component information and the noise component information, wherein the neural network filter estimator comprises a neural network unit and an inverse discrete-time Fourier transform unit; and said inputting the acoustic feature information into the neural network filter estimator to obtain the corresponding impulse response information comprises:

inputting the acoustic feature information to the neural network unit for analysis to obtain first complex cepstral information corresponding to harmonics and second complex cepstral information corresponding to noise; and converting, by the inverse discrete-time Fourier transform unit, the first complex cepstral information and the second complex cepstral information into first impulse response information corresponding to harmonics and second impulse response information corresponding to noise.

2. The method according to claim 1, wherein, said determining, by the harmonic time-varying filter, the harmonic component information by performing filtering processing based on the input impulse train and the impulse response information comprises: determining, by the harmonic time-varying filter, the harmonic component information by performing filtering processing based on the input impulse train and the first impulse response information; and said determining, by the noise time-varying filter, the noise component information based on the input impulse response information and the noise comprises: determining, by the noise time-varying filter, the noise component information based on the input second impulse response information and the noise.

3. The method according to claim 1, wherein said generating the synthesized speech based on the harmonic component information and the noise component information comprises:

inputting the harmonic component information and the noise component information to a finite-length mono-impulse response system to generate the synthesized speech.

4. A speech synthesis system, applied to an electronic device and comprising:

an impulse train generator configured to generate an impulse train based on fundamental frequency information of an original speech;

a neural network filter estimator configured to obtain corresponding impulse response information by taking acoustic feature information of the original speech as input;

a random noise generator configured to generate a noise signal;

a harmonic time-varying filter configured to determine harmonic component information by performing filtering processing based on the input impulse train and the impulse response information;

a noise time-varying filter configured to determine noise component information based on the input impulse response information and the noise; and an impulse response system configured to generate a synthesized speech based on the harmonic component information and the noise component information, wherein the neural network filter estimator comprises a neural network unit and an inverse discrete-time Fourier transform unit; and said obtaining the corresponding impulse response information by taking the acoustic feature information of the original speech as input comprises:

inputting the acoustic feature information to the neural network unit for analysis to obtain first complex cepstral information corresponding to harmonics and second complex cepstral information corresponding to noise; and converting, by the inverse discrete-time Fourier transform unit, the first complex cepstral information and the second complex cepstral information into first impulse response information corresponding to harmonics and second impulse response information corresponding to noise.

5. The system according to claim 4, wherein, said determining the harmonic component information by performing filtering processing based on the input impulse train and the impulse response information comprises: determining, by the harmonic time-varying filter, the harmonic component information by performing filtering processing based on the input impulse train and the first impulse response information; and said determining the noise component information based on the input impulse response information and the noise comprises: determining, by the noise time-varying filter, the noise component information based on the input second impulse response information and the noise.

6. The system according to claim 4, wherein the speech synthesis system adopts the following optimized training method before being used for speech synthesis:

the speech synthesis system is trained using a multi-resolution STFT loss and an adversarial loss for the original speech and the synthesized speech.

7. An electronic device comprising: at least one processor, and a memory communicatively coupled to the at least one processor, wherein the memory stores instructions executable by the at least one processor, the instructions being executed by the at least one processor to enable the at least one processor to perform the steps of the method of claim 1.

8. A non-transitory storage medium on which a computer program is stored, wherein the program, when being executed by a processor, performs the steps of the method of claim 1.

9. The system according to claim 4, wherein the speech synthesis system adopts the following optimized training method before being used for speech synthesis:

the speech synthesis system is trained using a multi-resolution STFT loss and an adversarial loss for the original speech and the synthesized speech.

10. The system according to claim 5, wherein the speech synthesis system adopts the following optimized training method before being used for speech synthesis:

the speech synthesis system is trained using a multi-resolution STFT loss and an adversarial loss for the original speech and the synthesized speech.

* * * * *